US011701791B2

(12) United States Patent
O'Halloran

(10) Patent No.: US 11,701,791 B2
(45) Date of Patent: Jul. 18, 2023

(54) EDGE PLANE

(71) Applicant: Woodpeckers, LLC, Strongsville, OH (US)

(72) Inventor: Edward Alan O'Halloran, Elyria, OH (US)

(73) Assignee: WOODPECKERS, LLC, Strongsville, OH (US)

( * ) Notice: Subject to any disclaimer, the term of this patent is extended or adjusted under 35 U.S.C. 154(b) by 270 days.

(21) Appl. No.: 17/001,883

(22) Filed: Aug. 25, 2020

(65) Prior Publication Data

US 2022/0063125 A1 Mar. 3, 2022

(51) Int. Cl.
*B27G 17/00* (2006.01)
*B27G 17/02* (2006.01)

(52) U.S. Cl.
CPC ..... *B27G 17/025* (2013.01)

(58) Field of Classification Search
CPC ..... B27G 17/02; B27G 17/025; B27C 1/002; B27C 5/006; B23D 1/003; B23D 1/08; B23D 1/10; B23D 1/12; B23D 9/00; B23D 13/06
See application file for complete search history.

(56) References Cited

U.S. PATENT DOCUMENTS 2,701,416 A * 2/1955 Snyder ..... B27G 17/025 30/481
6,615,497 B1 * 9/2003 Saunders ..... B27G 17/02 30/492
7,603,783 B2 * 10/2009 Lee ..... B27G 17/02 30/492
8,197,304 B2 * 6/2012 Hummel ..... B24D 15/06 451/380
2003/0177647 A1 * 9/2003 Moore ..... B27G 17/02 30/489

OTHER PUBLICATIONS

Lee Valley Tools, Veritas Iron Edge Plane, Mar. 13, 2012, https://www.youtube.com/watch?v=3qSySAJeBJ8 (Year: 2012).*
Popular Woodworking, A Different Way to Use a No. 95, Jun. 2, 2014, https://www.youtube.com/watch?v=yESh2pNt7w4 (Year: 2014).*
LeeValley Tools, Veritas Custom Bench Planes, Sep. 15, 2014, https://www.youtube.com/watch?v=U5c-jgOQAvY (Year: 2014).*
Lee Valley Tools, Veritas Variable Angle Fence for Veritas Planes, 2015 (Year: 2015).*
RobCosman.com, Chamfer plane, Stanley #72, Feb. 28, 2017, https://www.youtube.com/watch?v=FuY47ZeJKJA (Year: 2017).*
Wood by Wright, Making a Chamfer Plane With a Hand Plane, Oct. 25, 2018, https://www.youtube.com/watch?v=I78rJU_GygQ (Year: 2018).*
Hand Plane Central, Stanley #72 Chamfer Plane, Nov. 11, 2022, https://www.handplane.com/5/the-stanley-72-chamfer-plane/ (Year: 2022).*

* cited by examiner

*Primary Examiner* — Matthew Katcoff
(74) *Attorney, Agent, or Firm* — Sand, Sebolt & Wernow Co., LPA

(57) ABSTRACT

A method and apparatus for edging boards using an exemplary edge plane is shown and described herein. The method and apparatus for edging boards uses a cutting edge on the blade and an adjusting mechanism engageably coupled thereto. The method for edging boards using an edge plane apparatus adjusts the height or depth of the cutting edge to make a cut in the on the corner of a board or other such material.

18 Claims, 12 Drawing Sheets

EDGE PLANE

TECHNICAL FIELD

Generally, the disclosure relates to a method and apparatus for manipulating edges on boards. Particularly, the disclosure relates to a method and apparatus for edging boards with a cutting edge on the blade and an adjusting mechanism. Specifically, the disclosure relates to a method and apparatus for edging boards with a cutting edge on the blade, an adjusting mechanism, a first angled side, and a second angled side at a right angles to each other.

BACKGROUND

Background Information

In order to create an aesthetically pleasing bevel on wood, many woodworkers and carpenters turn to a guide bit. Material should be removed in multiple tedious and light passes, as when too much wood is removed at one time, there is an increased likelihood of splintering or otherwise make rough cuts on the wood itself. The workpiece desired to be beveled must be affixed to a surface as routers are quite powerful tools. As a powerful tool, protective eyewear and ear protection should be used as routers tend to throw a lot of material and are very loud. The router must be moved at a steady pace. Once every pass is completed, the router must be adjusted, adding time and effort.

Other methods used include using a hand plane to create a bevel containing workpiece include using a hand plane. The use of a hand plane to create a bevel is rather unwieldly as the edge desired to be beveled is likely much thinner than the width of the blade on the hand plane. Therefore, multiple passes must be made with outstanding precision. Otherwise, even a skilled woodworker may err and ruin a near finished workpiece.

SUMMARY

As such, a need to make easy and safe clean cuts to provide a bevel or otherwise softer edge is needed within the woodworking field.

In one aspect, an exemplary embodiment of the present disclosure may provide a woodworking edge plane comprising: a blade; a cutting edge on the blade; an adjusting mechanism in operative connection with the blade for adjusting the height of the blade relative to a surface; a first angled side; and a second angled side; wherein the first angled side and second angled sides are operative to contact at least two sides of a work piece. This embodiment or another exemplary embodiment may provide wherein the adjustment mechanism is connected to the blade via threads. This embodiment or another exemplary embodiment may provide a body comprising: at least one first piece and at least one second piece. This embodiment or another exemplary embodiment may provide a blade channel operative to house at least a portion of the blade and a wheel aperture operative to house the adjusting mechanism within the body of the woodworking edge plane. This embodiment or another exemplary embodiment may provide, wherein the adjustment mechanism is an adjustment wheel. This embodiment or another exemplary embodiment may provide the adjustment wheel is in threaded connection with the blade. This embodiment or another exemplary embodiment may provide wherein the blade comprises: a first end, wherein the cutting edge is located at the first end, a second end, a central portion between the first end and second end, a projected portion between the central portion and the first end with a first width; and a recessed portion between the projected portion and the first end with a second width. This embodiment or another exemplary embodiment may provide the first width is greater than the second width. This embodiment or another exemplary embodiment may provide the projected portion prevents the blade from overextending. This embodiment or another exemplary embodiment may provide the cutting edge has a third width. This embodiment or another exemplary embodiment may provide the third width is greater than that of a width of the blade channel to prevent the cutting edge of the blade from retracting within a body of the tool. This embodiment or another exemplary embodiment may provide the first angled side and second angled side are at a 90 degree angle relative to one another. This embodiment or another exemplary embodiment may provide at least one blade window adapted to provide a path for material removed. This embodiment or another exemplary embodiment may provide the blade extends at least partially laterally below a top of the first angled side and second angled side.

In another aspect, a further exemplary embodiment of the present disclosure may provide a method of shaping the edges of boards comprising: placing a tool on a first side and a second side of an edge of material desired to be sharpened; adjusting an adjustment mechanism in contact with a blade with a cutting edge; passing the tool over the edge; contacting the blade with the edge; and removing material from the edge to create a new rounded or an angled surface. In another aspect, an exemplary embodiment of the present disclosure may provide passing the tool over the edge without adjusting the adjustment mechanism; and making no contact with the blade with the edge or the new rounded or angled surface. In another aspect, an exemplary embodiment of the present disclosure may provide adjusting the adjustment mechanism; moving the cutting edge of the blade closer to the new rounded or angled surface; passing the tool over the new rounded or angled surface; contacting the blade with the new rounded or angled surface; and removing material from the edge to create a deeper rounded or an angled surface. In another aspect, an exemplary embodiment of the present disclosure may provide orienting the tool on the first side and second side wherein the first side and second side are at right angles to one another. In another aspect, an exemplary embodiment of the present disclosure may provide prior to passing the tool over the edge: grasping the tool; and applying pressure toward the edge of the material. In another aspect, an exemplary embodiment of the present disclosure may provide removing the material through at least one blade window.

In another aspect, an exemplary embodiment of the present disclosure may provide (insert language from claim)

In another aspect, and exemplary embodiment of the present disclosure may provide (insert language from claim)

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

A new edge plane 10 and method of operation thereof is depicted in the present disclosure and throughout FIGS. 1-11C. The disclosure focuses on an improved edge plane that bevels or shapes materials, as will be discussed hereinafter.

Figure 1:
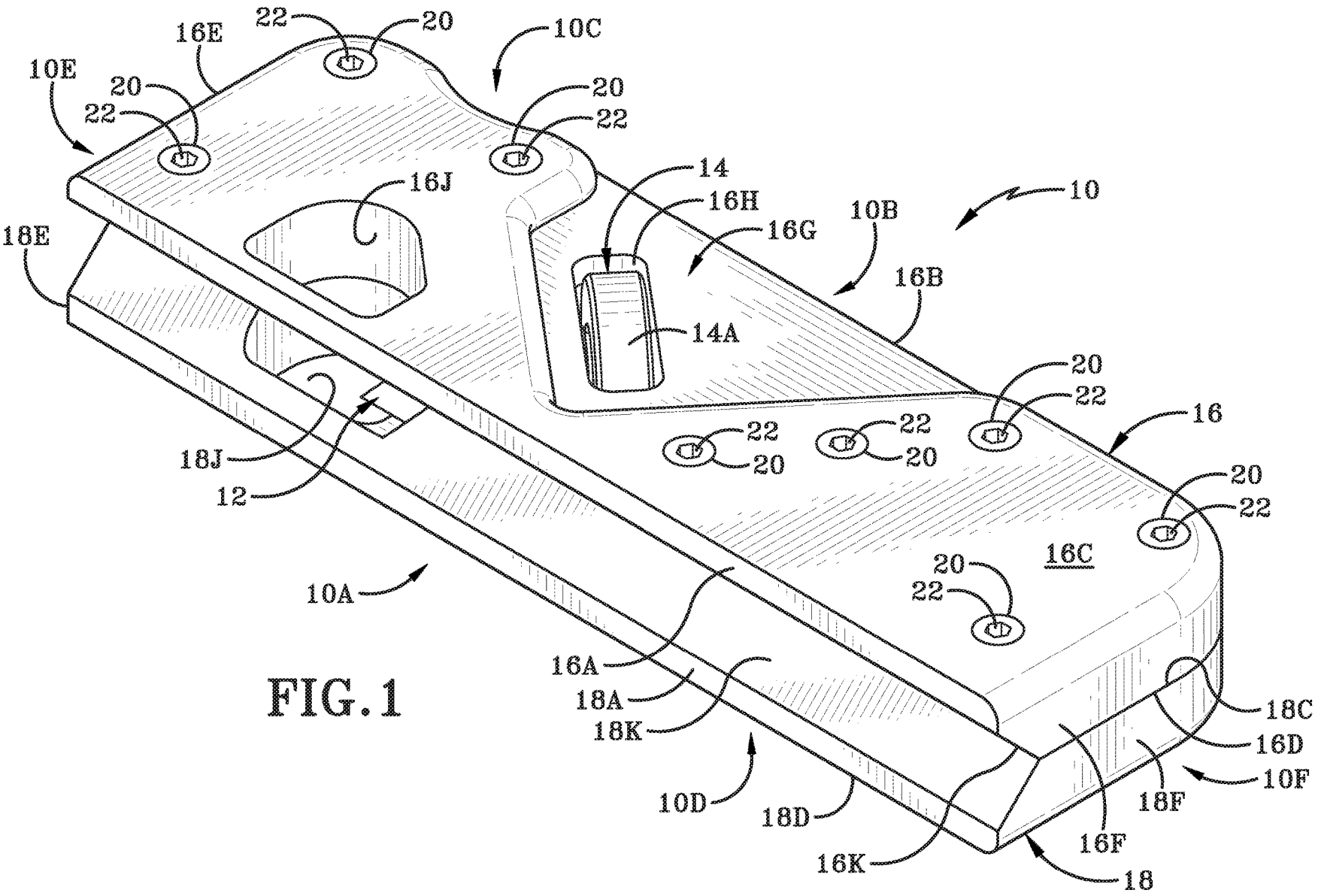
FIG. 1 (FIG. 1) is a front, top, right side isometric perspective view of an edge plane.

Referring specifically to FIG. 1 a perspective view of an edge plane 10 is shown. The edge plane 10 is shown as if it were in contact with the ground or other surface (not shown). The edge plane 10 has a body that is generally rectangular cubic with rounded edges. The edge plane 10 includes a blade 12 in operative connection with an adjusting mechanism or adjusting wheel 14.

The edge plane 10 has a front side 10A and a back side 10B transversely disposed thereto. Further, there is a top side 10C and a bottom side 10D vertically opposed thereto. The edge plane 10 further includes a first side 10E and a second side 10F longitudinally opposed thereto.

The edge plane 10 body generally consists of two pieces, a first piece 16 and a second piece 18. The first piece 16 has a front side 16A and a back side 16B transversely disposed thereto. Further, there is a top side 16C and a bottom side 16D vertically opposed thereto. The first piece 16 further includes a first side 16E and a second side 16F longitudinally opposed thereto. While the second piece 18 has a front side 18A and a back side 18B transversely disposed thereto. Further, there is a top side 18C and a bottom side 18D vertically opposed thereto. The second side 18 further includes a first side 18E and a second side 18F longitudinally opposed thereto.

The first piece 16 includes a plurality of fastener apertures 20 with fasteners 22 within said apertures 20. The first piece further includes a recessed region 16G as well as a wheel aperture 16H and a blade window 16J. The recessed region 16G is generally triangular in nature and includes the wheel aperture 16H. The wheel aperture 16H allows for free rotation of the adjusting wheel 14 as will be discussed with respect to operation. Further, the blade window 16J allows for a view of the blade 12 and its depth it is extended that will be discussed with respect to operation as well.

The first piece 16 interfaces with the second piece 18 at the bottom 16D of the first piece 16 and the top 18C of the second piece. Each the first piece 16 and the second piece 18 has an angled or a tapered side 16K, 18K respectively. The tapered side 16K connects the front side 16A to the bottom side 16D while the tapered side 18K connects the front side 18A to the top side 18C. The tapered side 16K is at a right angle to the tapered side 18K.

Figure 2:
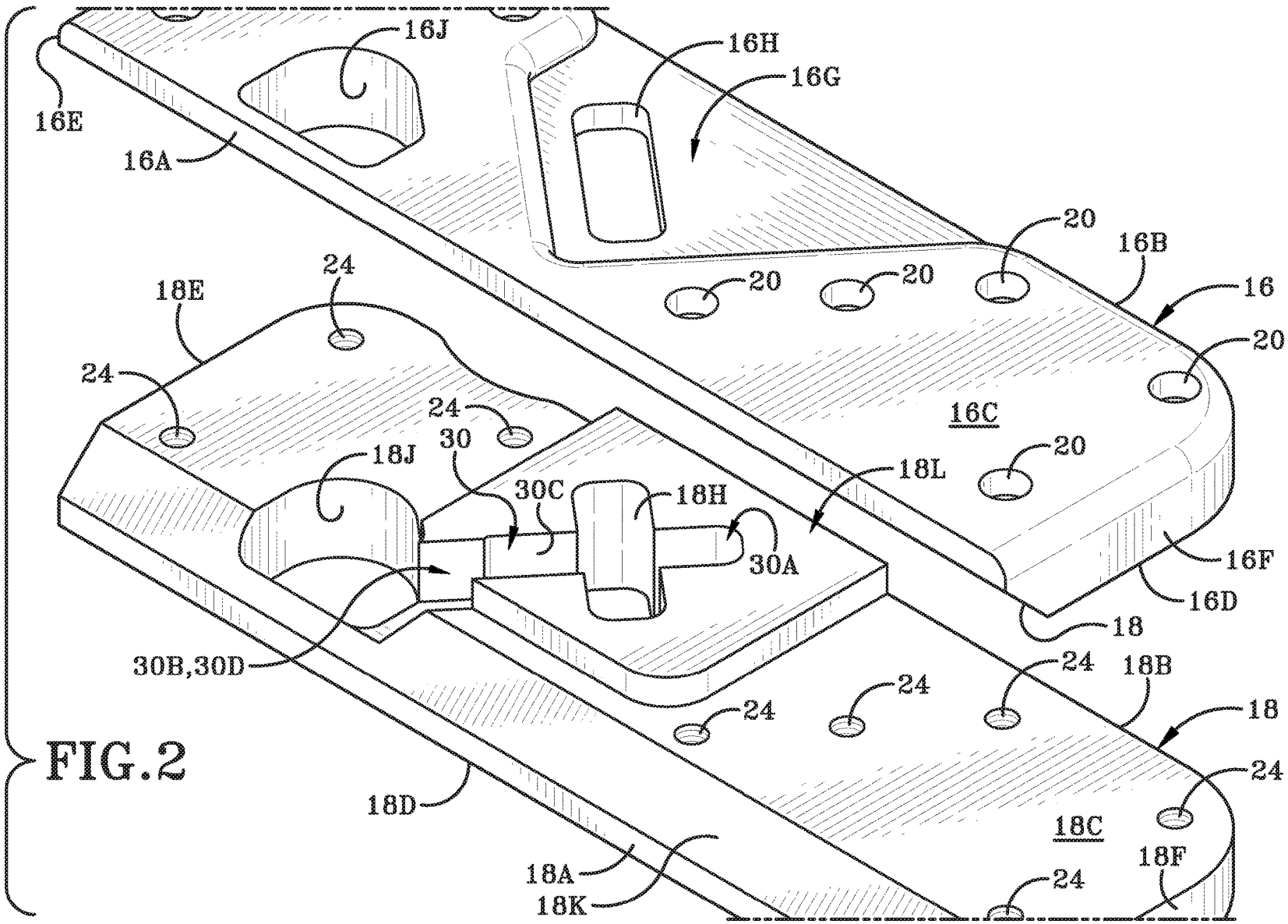
FIG. 2 (FIG. 2) is a partially exploded front, top, right side isometric perspective view of the edge plane.

Referring now to FIG. 2, a partially exploded perspective view of the edge plane 10 is shown. In this view, the first piece 16 is shown separated from the second piece 18 with the blade 12 and adjusting wheel 14 removed. Further shown in this view are a further set of fastener apertures 24 that are located on the second piece 18. A fastener 22 is operative to be placed through the fastener aperture 20 on the first piece 16 and extend into the further set of fastener apertures 24. In the exemplary embodiment, the further set of fastener apertures 24 are threaded apertures.

Then, as the fasteners 22 are tightened, the first piece 16 and second piece 18 are operative to be in interfacing engagement at the bottom 16D of the first piece 16 and the top 18C of the second piece. In the exemplary embodiment the fasteners 22 may be screws, but may be any such similarly situated mechanism.

The second piece further includes a wheel aperture 18H that is operative to house the adjusting wheel 14 and its components, as will be discussed later. The second piece 18 also includes a blade window 18J that allows for a view of the blade 12 and its depth.

Figure 3:
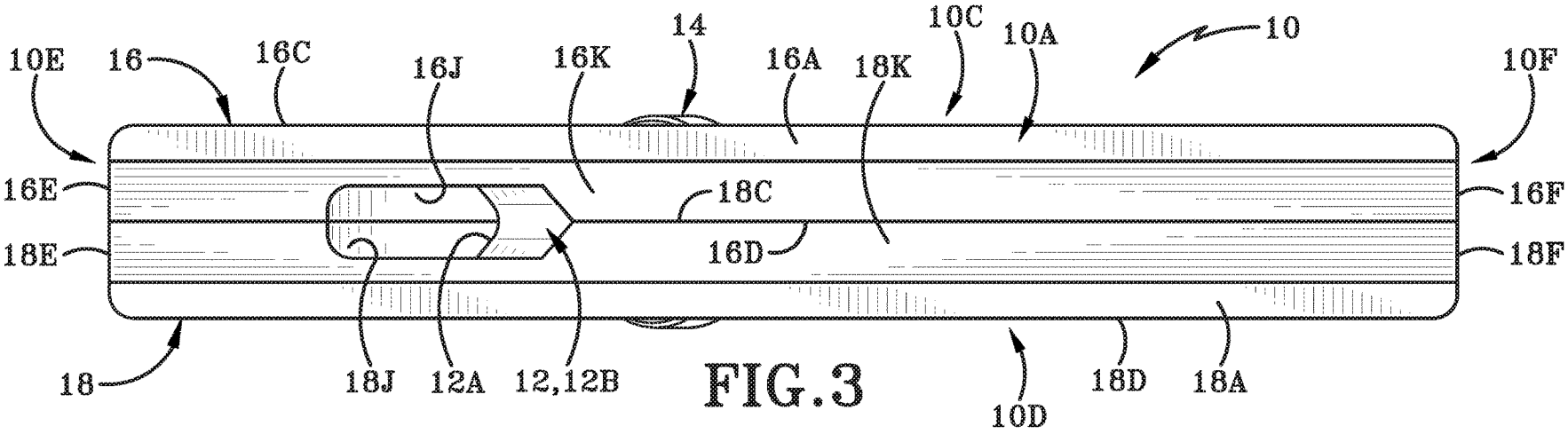
FIG. 3 (FIG. 3) is a front elevation view of the edge plane.
Figure 4:
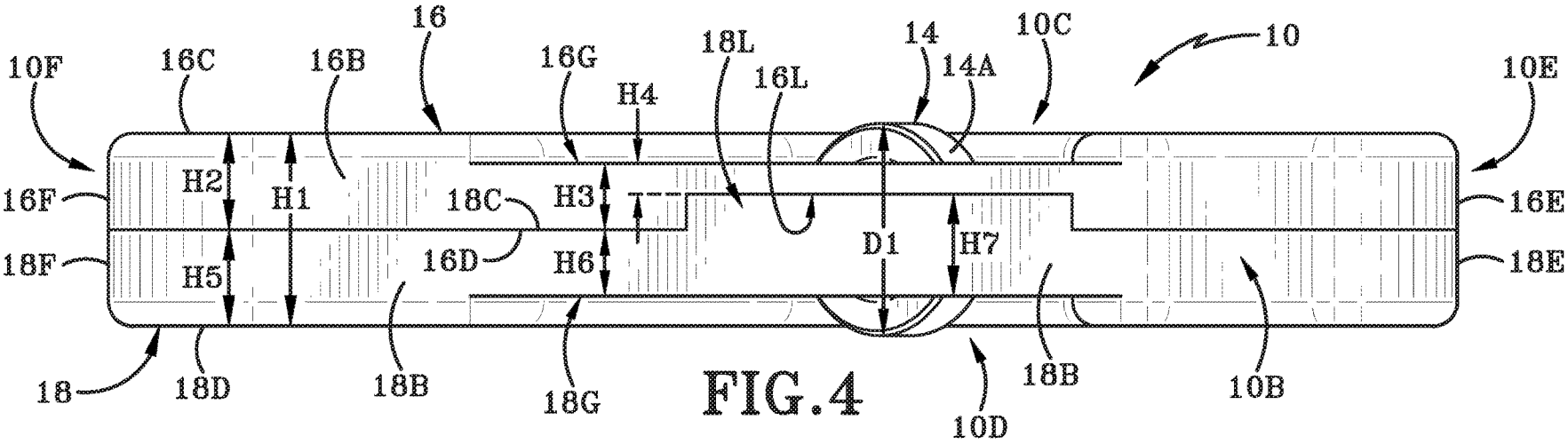
FIG. 4 (FIG. 4) is a rear elevation view of the edge plane.

Referring now to FIG. 3 and FIG. 4, front and rear elevation views of the edge plane 10 are shown. The second piece 18 further includes a projection region 18G that is operative to be underneath a portion of the recessed region 16G and complementary to the projection shown as 16L and interfaces without a gap therebetween. The adjusting wheel 14 is able to be seen to have a generally cylindrical body that has an outer surface 14A that traces the adjusting wheel 14. The adjusting wheel 14 is shown to have a diameter D1 that is slightly larger than the width H1 of the edge plane 10. Though, in further embodiments, the diameter D1 could be smaller than the width H1 of the edge plane 10.

Further as can be seen from these views, the first piece 16 has a first height H2, a second height H3, and a third height H4 while the second piece has a first height H5, a second height H6, and a third height H7. In the shown embodiment the first height H2 of the first piece 16 and the first height H5 of the second piece 18 equal the height H1 of the entire edge plane. Further, shown is the second height H3 of the first piece and the second height H6 of the second piece 18 equal the height of the third height H4 of the first piece 16 and the third height H7 of the second piece 18. The third height H4 of the first piece 16 is less than the third height H7 of the second piece 18. This height H7 is so the projection region 18G is able to sit flat with the recessed region 16G. Of course, these heights are merely an expression of an exemplary embodiment and other heights and ultimate geometry of further edge planes may be modified as deemed fit.

Figure 5:
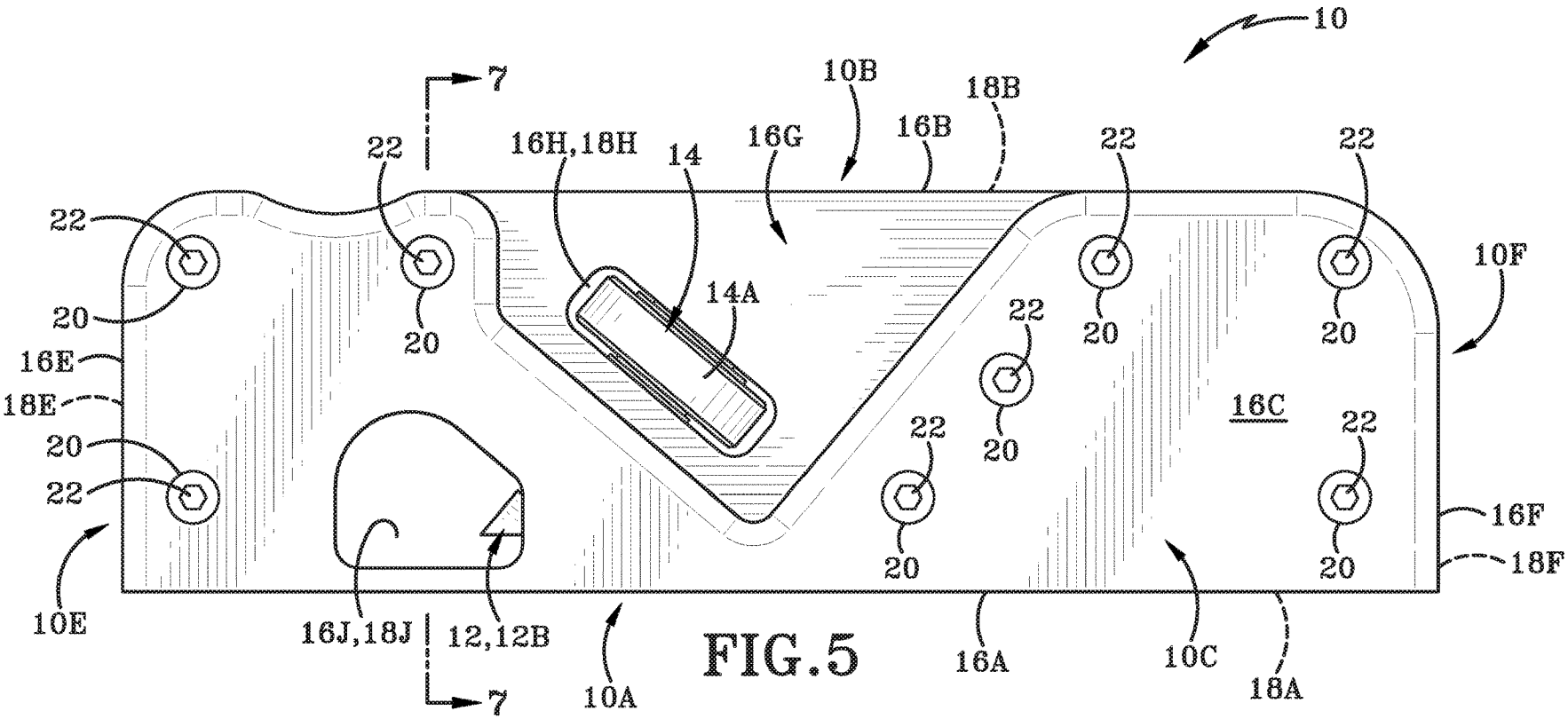
FIG. 5 (FIG. 5) is a top plan view of the edge plane.
Figure 6:
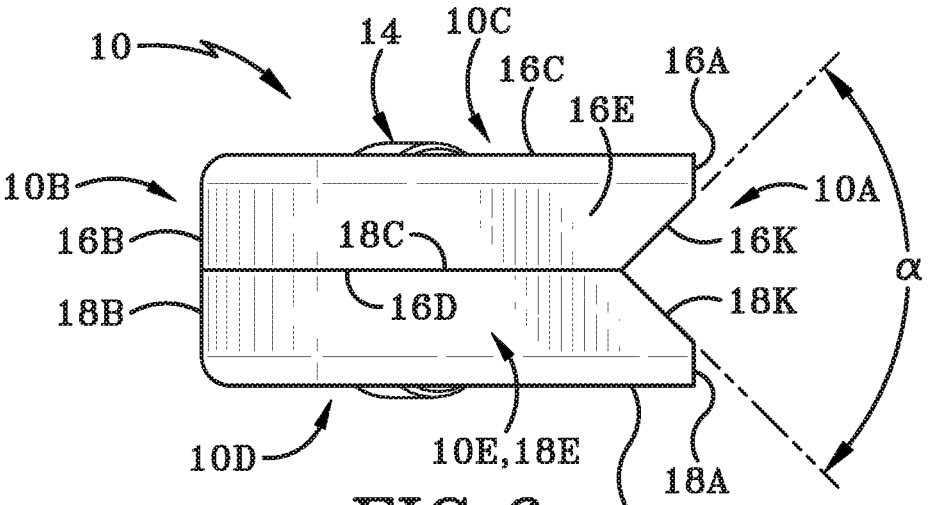
FIG. 6 (FIG. 6) is a left side elevation of the edge plane.
Figure 7:
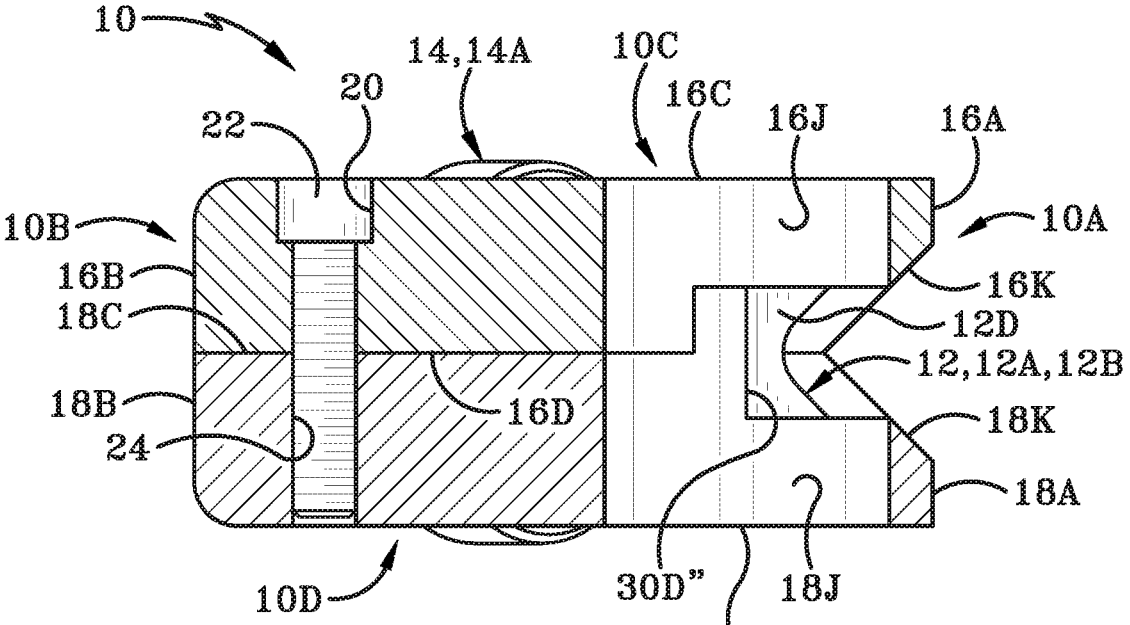
FIG. 7 (FIG. 7) is a cross sectional view of the edge plane taken along line 7-7 of FIG. 5.

Referring specifically to FIGS. 5-7, the blade window 16J of the first piece 16 is displaying the cutting edge 12A of the blade 12. FIG. 6, taken along the left side of the edge plane 10, shows an angle α. The angle α corresponds to the distance between the tapered side 16K of the first piece 16 and the tapered side 18K of the second piece 18. In the exemplary embodiment this angle is a perfect 90 degrees.

Referring specifically to FIG. 7, a cross sectional view of the edge plane 10 taken along line 7-7 of FIG. 5 is shown. The fastener 20 is shown passing through the first piece 16 at its fastener aperture where it also passed through a portion of the further fastener apertures 24 located on the second piece 18. Further, the cutting edge 12A of the blade 12 is shown above the height of the tapered sides 16K, 18K of the respective piece 16, 18.

Figure 8A:
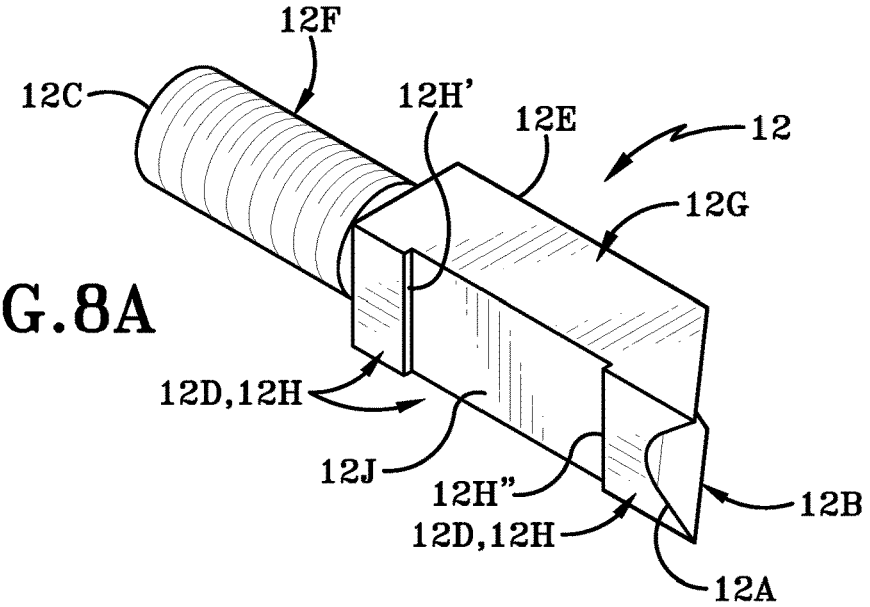
FIG. 8A (FIG. 8A) is a front, top, right side isometric perspective view of an exemplary cutting blade.
Figure 8B:
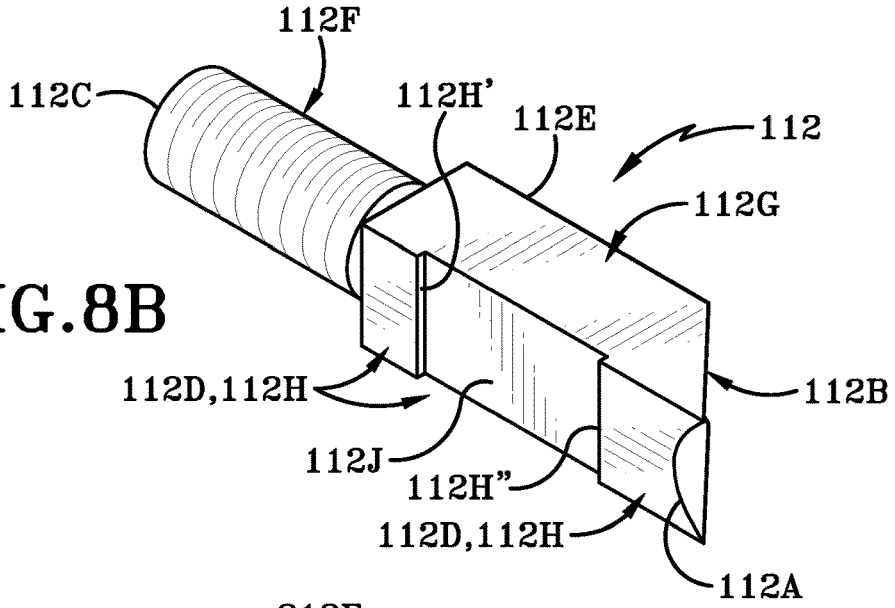
FIG. 8B (FIG. 8B) is a front, top, right side isometric perspective view of a further exemplary cutting blade.
Figure 8C:
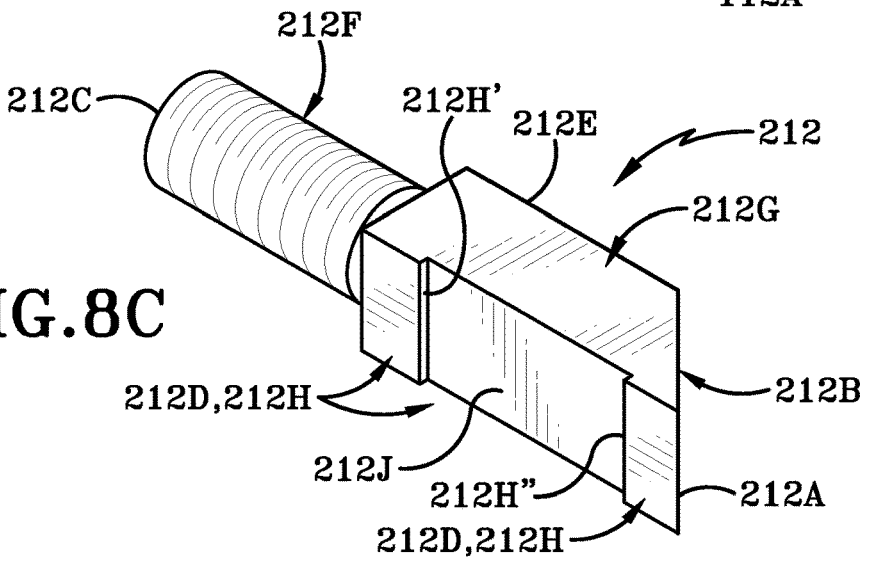
FIG. 8C (FIG. 8C) is a front, top, right side isometric perspective view of a yet another exemplary cutting blade.

Referring now to FIGS. 8A-8C, a few exemplary blades 12 (FIG. 8A), 112 (FIG. 86), 212 (FIG. 8C) are shown. All of the blades 12, 112, 212 have a similar body structure including a cutting edge 12A, 112A, 212A on a first end 12B, 112B, 212B of the respective blade 12, 112, 212. The cutting edge 12A, 112A, 212A may be rounded in the case of 12A and 112A in order to create a rounded edge, or it may be straight in the case of 212A to create a beveled or angled edge on a workpiece. Exemplary embodiments may include blades operative to create, but are not limited to: a ⅛" radius, a 3/16" radius, a ¼" radius or a 45 degree chamfer.

The blades 12, 112, 212 further have a second end 12C, 112C, 212C opposite and longitudinally disposed from the respective first end 12B, 112B, 212B. The blades further include an outer side 12D, 112D, 212D and an inner side 12E, 112E, 212E. Proximate to the second end 12C, 112C, 212C is a threaded portion 12F, 112F, 212F. The threaded portion 12F, 112F, 212F is operative to be threaded into the adjusting wheel 14 as will be discussed with respect to FIG. 9A. The threaded portion 12F, 112F, 212F is abutted against the central portion 12G, 112G, 212G. The central portion 12G, 112G, 212G, a projected portion 12H, 112H, 212H, with a near end 12H', 112H', 212H' and an outer end 12H", 112H", 212H", a recessed portion 12J, 112J, 212J and the cutting edge 12A, 112A, 212A. The projected portion 12H, 112H, 212H has a greater width than the recessed portion 12J, 112J, 212J and an identical or near identical width to the cutting edge 12A, 112A, 212A.

Having thus described an exemplary non-limiting configuration of the exemplary edge plane 10, its operation will be discussed with reference to some exemplary features used with the various embodiments.

Figure 9A:
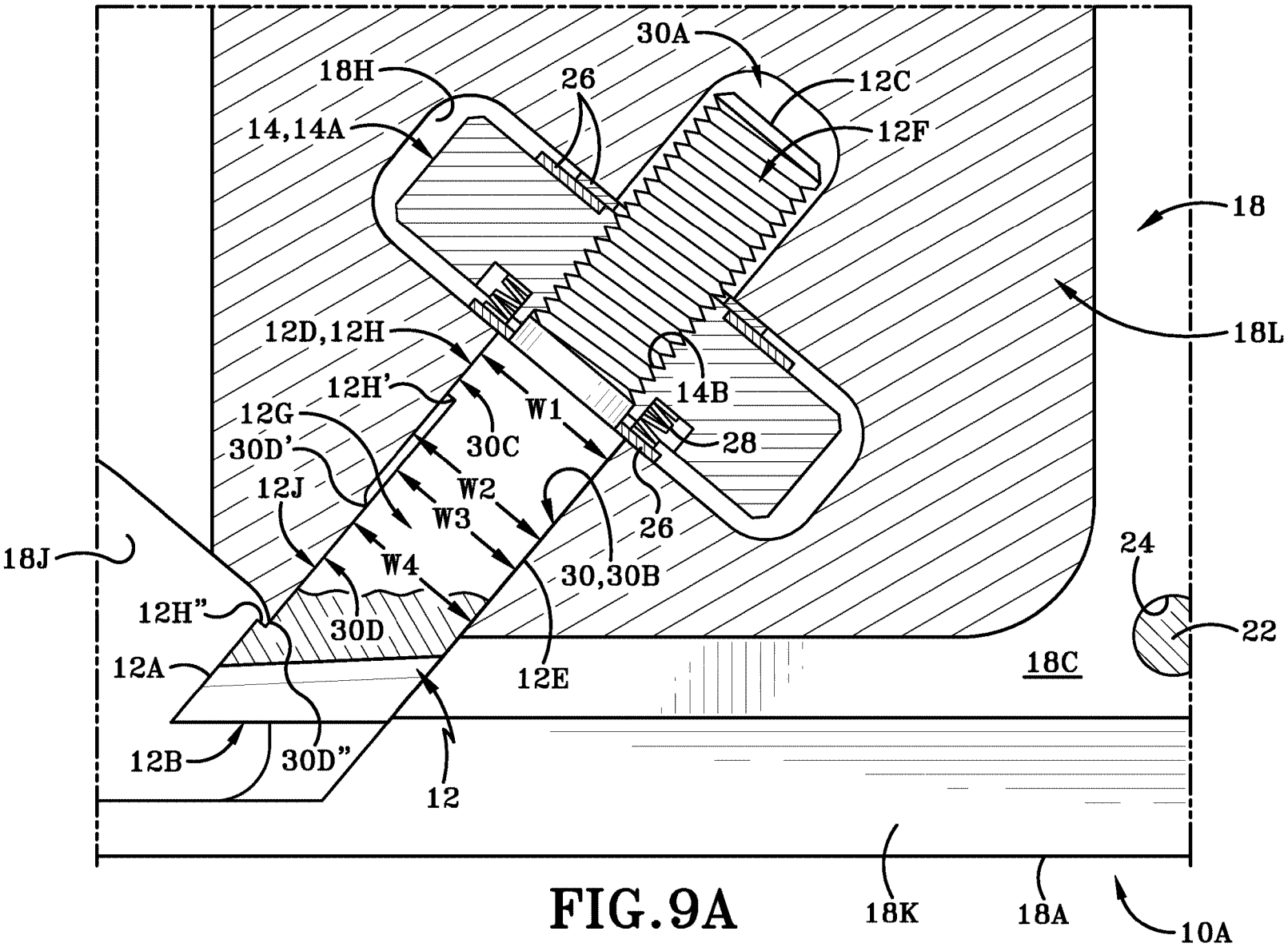
FIG. 9A (FIG. 9A) is an operational view of an exemplary blade in the retracted position.

Referring now to FIG. 9A, an operational view of an exemplary blade 12 is shown in the retracted position. The blade 12 is attached to the adjusting wheel 14 via its threaded portion 12F through a threaded through hole 14B located on the adjusting wheel 14. Within the wheel aperture 16H, 18H also may include at least one washer 26, and at least one spring 28.

Further seen in this view is the blade channel 30. The blade channel 30 has a first end 30A and a second end 30B longitudinally disposed thereto. The first end 30A is adapted to accept a portion of the threaded portion 12F while the second end 30B is adapted to accept the central portion 12G of the blade 12. The second end 30B is operative to be the same or slightly smaller than the width W1 at the near end 12H' than the width at a wider portion 30C with a width W2. Similarly, the second end 30B is operative to be the same or slightly smaller than the width W3 at the outer end 12H" than the width W4 at a narrower portion 30D. The wider portion 30C is slighter larger than the projected portion 12H of the blade 12 while the narrower portion 30D is more narrow than a portion of the cutting edge 12A. Therefore, W1 and W2 are greater than W3 and W4.

Figure 9B:
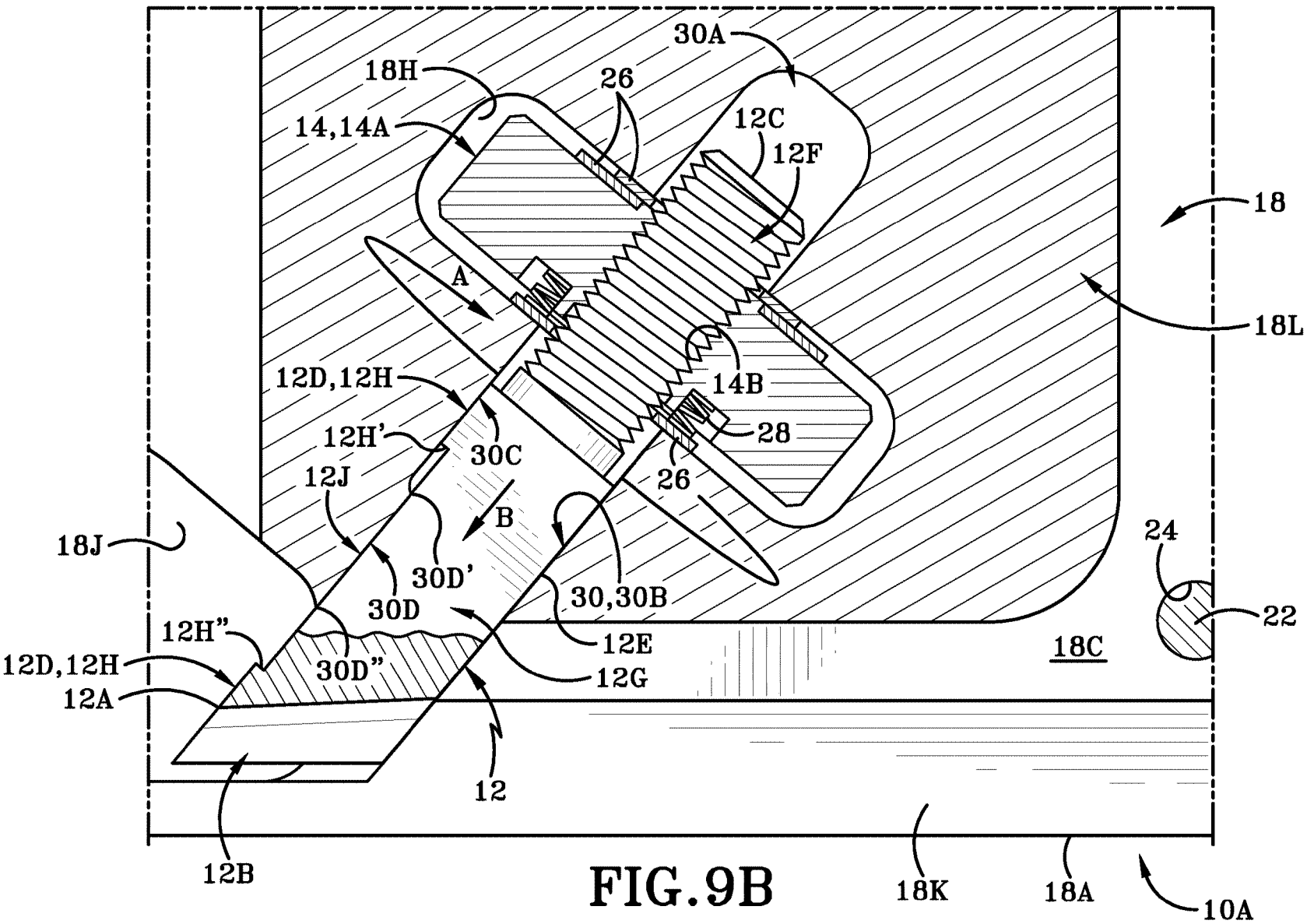
FIG. 9B (FIG. 9B) is an operational view of the exemplary blade in the extended position.

Referring now to FIG. 9B, an operational view of the exemplary blade 12 in the extended position is shown. Here, an operator may rotate the adjusting wheel in a direction "A". As a result of the rotation "A" the blade 12 moves within the blade channel 30 from the first end 30A to the second end 30B in a direction "B". The movement of the blade 12 extends the blade to expose more of the cutting edge 12A. The blade 12 may be moved via the rotation of the adjusting wheel 14 until the near end 12H' of the projected portion 12H of the blade 12 makes contact with the top 30D' of the narrower portion 30D of the blade channel 30 which stops the extension of the blade 12. This also prevents unthreading of the threaded through hole 14B of the adjusting wheel 14 with the threaded portion 12F of the blade 12.

Similarly, an operator may rotate the adjusting wheel in an opposite direction (not shown). As a result of this rotation, the blade 12 moves within the blade channel 30 from the second end 30B towards the first end 30A. The movement of the blade 12 retracts the blade to expose less of the cutting edge 12A. The blade 12 may be moved via the rotation of the adjusting wheel 14 until the outer end 12H" makes contact with the edge 30D" of the narrower portion 30D at the second end 30B which stops the retraction of the blade 12 any further.

Figure 10:
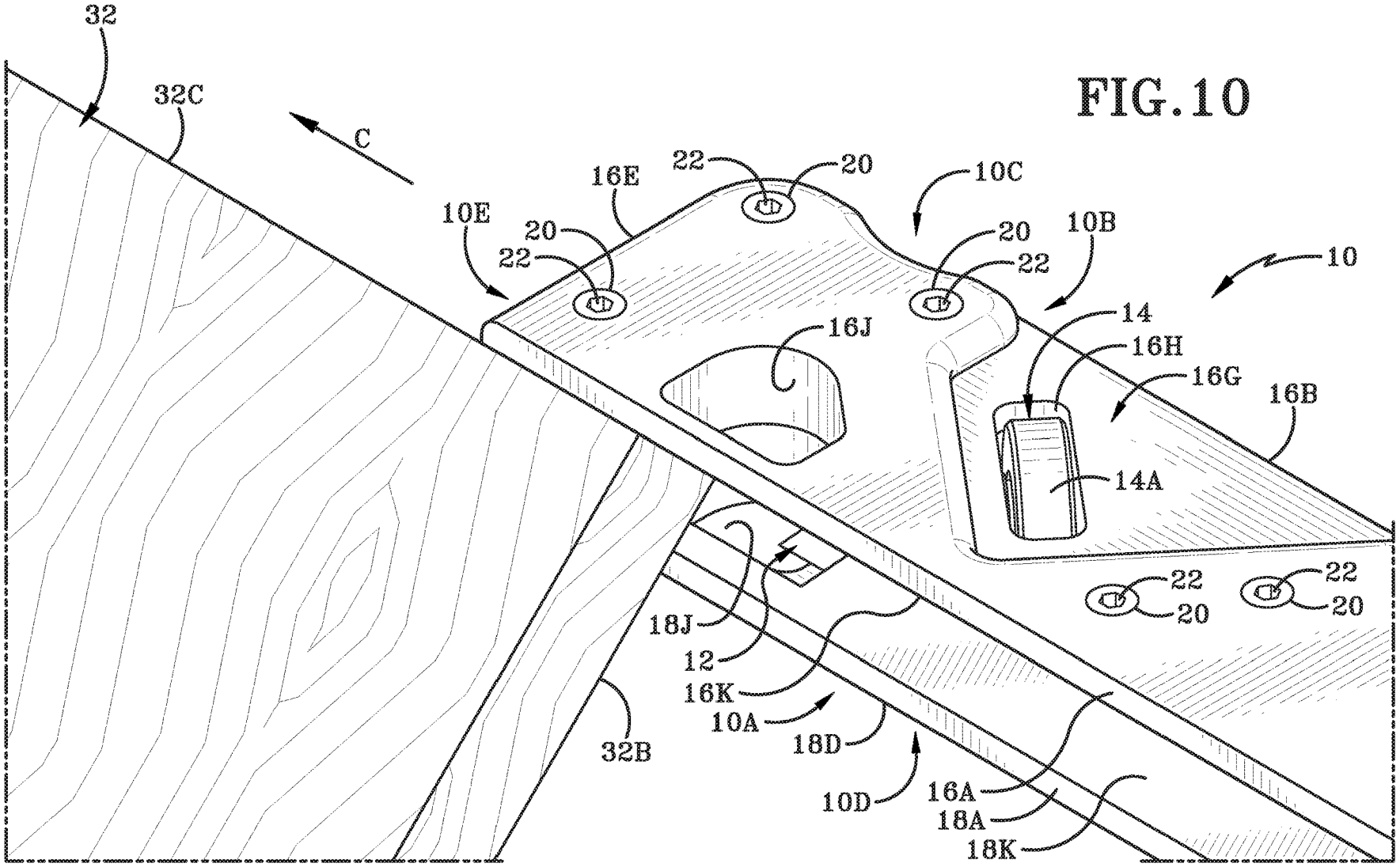
FIG. 10 (FIG. 10) is operational view of the edge plane moving along a board.

Referring specifically to FIG. 10, an operational view of the edge plane 10 moving along a board 32 is shown. The edge plane 10 is aligned along an edge 32A desired to be rounded or flattened. The edge plane 10 sits on a first face 32B of the board 32 at the tapered side 16K of the first piece 16 while the edge plane sits on a second face 32C of the board 32 at the tapered side 18K of the second piece 18. As a result, the edge plane 10 is able to ride along the board at a perfect right angle so as to shave the edge 32A to a desired shape.

An operator would rotate the adjusting wheel 14 along its outer surface 14A. This rotation would allow the threaded through hole 14B to engage with the threaded portion 12F of the blade 12 and put the cutting edge 12A closer to the edge 32A of the board 32. The operator may then begin making movements along arrow "C" of the edge plane 10 along the board 32. When the cutting edge 12A of the blade 12 begins making contact with the board 32, the operator may then continue to adjust the adjusting wheel 14 to move the blade 12 in order to make deeper cuts along the edge 32A of the board 32.

However, the operator will not continue to make cuts if the adjusting wheel 14 and in result the blade 12, are not moved to be in further contact with a board. This is in contrast to prior art edge planes, in that any subsequent pass would result in more material being removed. With the edge plane 10 of the present disclosure, without rotating the adjusting wheel 14 to cause the blade 12 to approach the board, no further cut of the edge would be made.

Figure 11A:
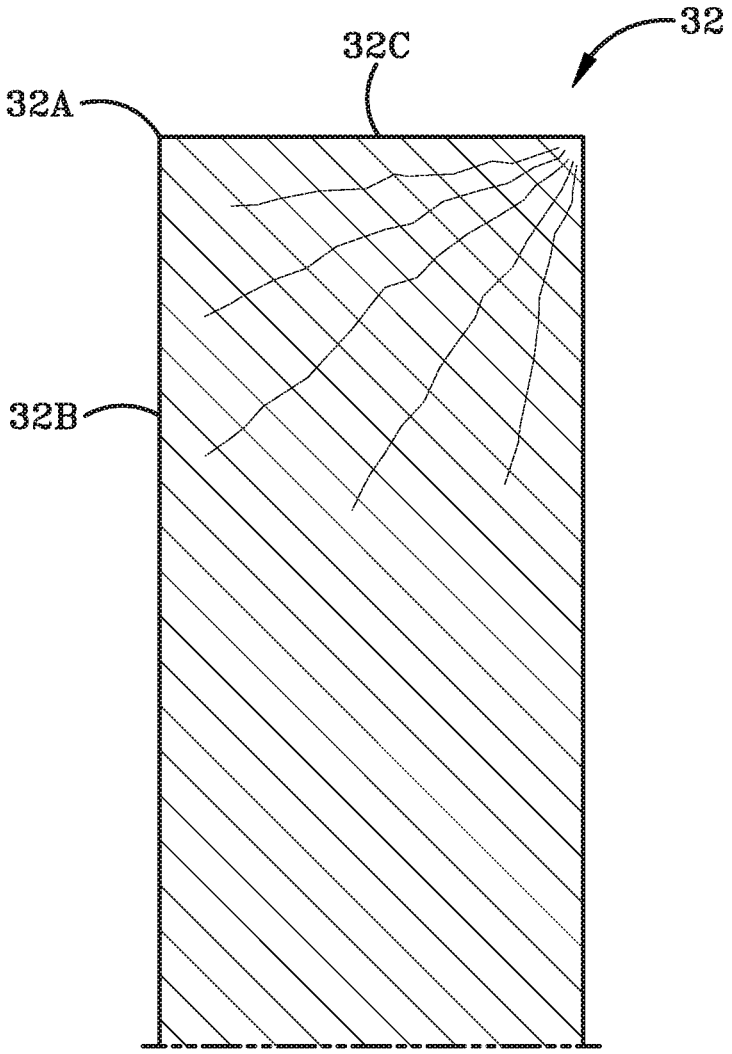
FIG. 11A (FIG. 11A) is an end view of a standard board.
Figure 11B:
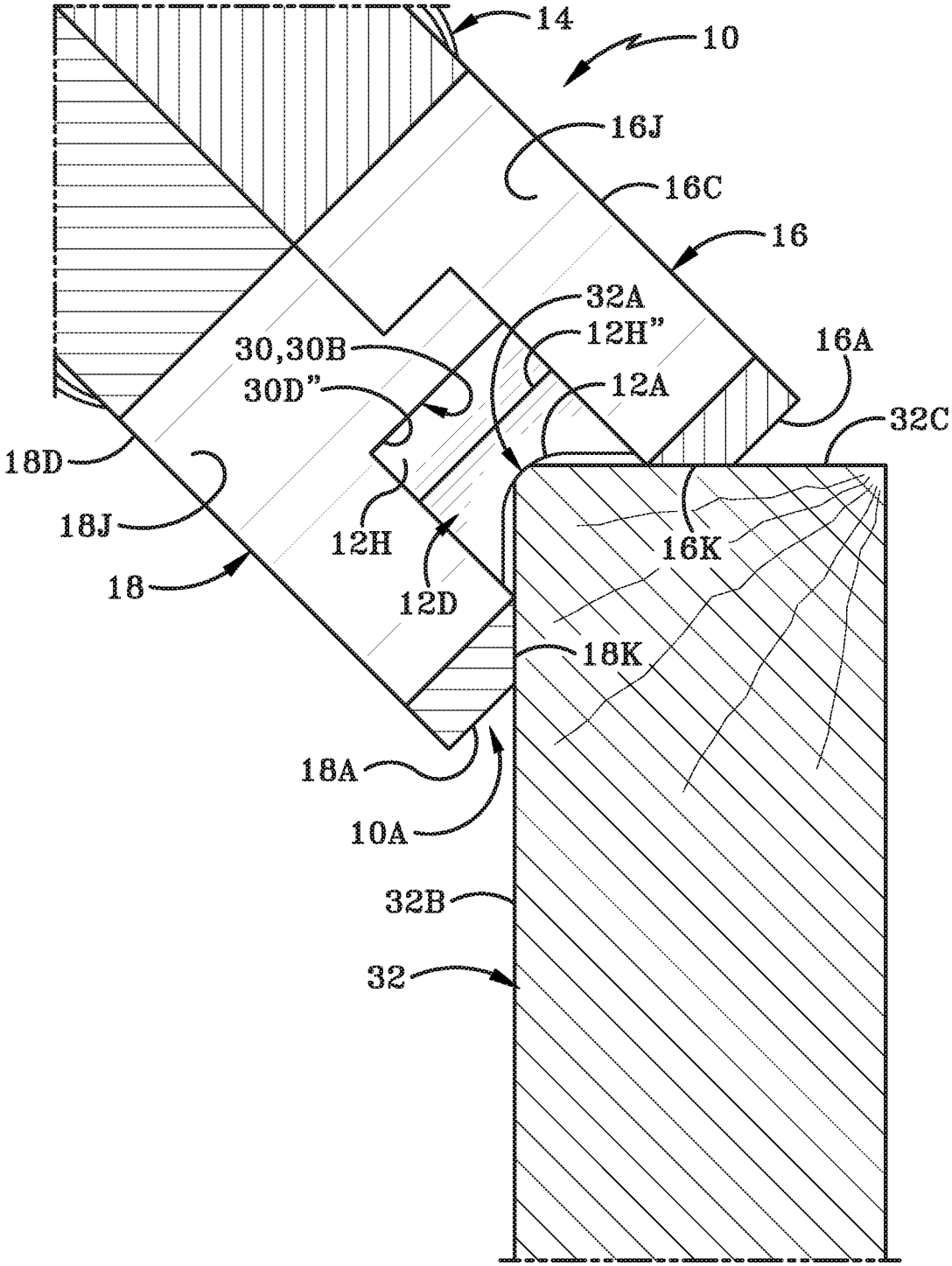
FIG. 11B (FIG. 11B) is an end view of the standard board with the edge plane aligned on a corner of the board.
Figure 11C:
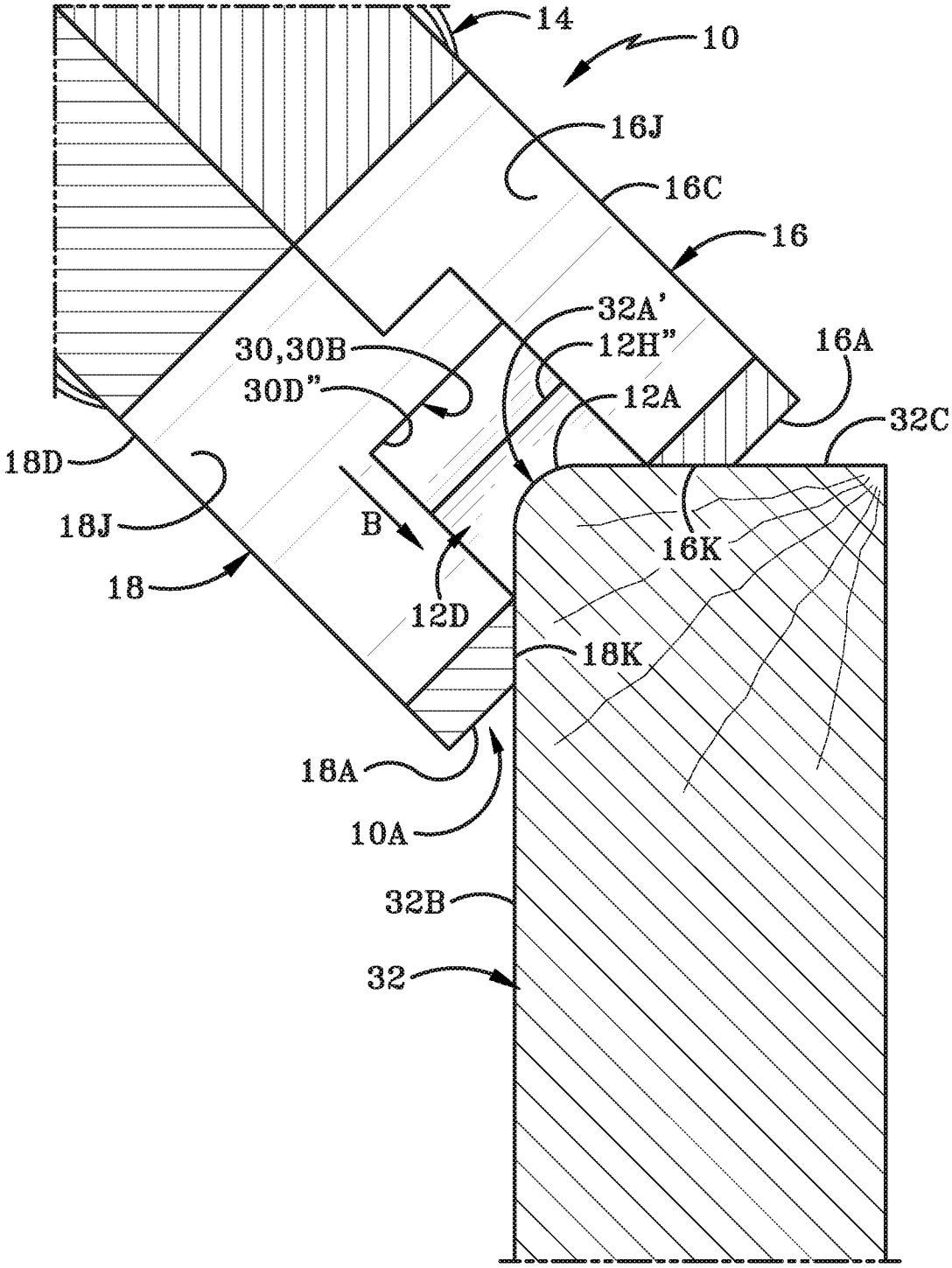
FIG. 11C (FIG. 11C) is an operational end view of the standard board with an exemplary blade of the edge plane in contact with the corner of the board.

Referring now to FIG. 11A-FIG. 11C operational views with exemplary blade 12 of the edge plane 10 in contact with the edge 32A of the board 32 transforming the edge to a more desired shape is shown. In FIG. 11A, a traditional board 32 with a sharp edge 32A is shown. The edge plane 10 is aligned along an edge 32A desired to be rounded or flattened. The edge plane 10 sits on a first face 32B of the board 32 at the tapered side 16K of the first piece 16 while the edge plane sits on a second face 32C of the board 32 at the tapered side 18K of the second piece 18. The contour of the board along with the angle between the tapered sides 16K, 18K align the edge plane 10. As the cutting edge 12A of the blade 12 contacts the edge, it begins to round it off to make it less sharp. The material removed this way is operative to travel through the blade windows 16J, 18J located on the first piece 16 and second piece 18. As the blade 12 is lowered and the cutting edge 12A of the edge plane 10 is in contact with the board, additional material is shaved off of the corner to make it a rounded edge 32A'. The corner 32A may be turned into a beveled or chamfered edge by taking off the material with additional blades 112, 212 as described herein in an identical way of operation of the edge plane 10.

Further, though not shown, a user may remove one blade and replace it with another. The fasteners 22 may be removed to no longer hold in engagement the first piece 16 and second piece 18. The first piece 16 may lift off to expose the blade 12 and the adjustment wheel 14. The blade 12 may be removed from the blade channel 30. The blade 12 may then be unthreaded via the threaded portion 12F from the threaded through hole 14B of the adjusting wheel 14. Any washers 26 are removed, along with the stacked wave disk spring 28. The new blade may then be attached by replacing any washers 26, replacing the stacked wave disk spring 28, and rotating the adjusting wheel 14 in the opposite direction. The new blade, now attached to the adjusting wheel 14 may then be placed back within the body of the wheel aperture 18H of the second piece 18 and the blade channel 30. Then, the fastener apertures 20 on the first piece 16 may be aligned with the further fastener apertures 24 on the second piece 18 and fasteners reengaged with each piece until the first piece 16 and second piece 18 are in fixed engagement with one another to form the edge plane 10.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "element A and/or element B", when used in conjunction with open-ended language such as "comprising" can refer, in one embodiment, to element A only (optionally including elements other than element B); in another embodiment, to element B only (optionally including elements other than element A); in yet another embodiment, to both element A and element B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clarity, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A woodworking edge plane comprising:

a first piece of a body having a first angled side;

a second piece of the body having a second angled side;

a blade having a cutting edge thereon operable to engage and shape a corner of a work piece; and an adjusting mechanism in operative connection with the blade for adjusting the height of the blade relative to the corner of the work piece;

wherein the first and second piece of the body contain the blade and the adjusting mechanism therebetween; and wherein the first angled side and second angled sides are operative to contact at least two sides of the work piece.

2. The woodworking edge plane of claim 1, wherein the adjusting mechanism is connected to the blade via threads.

3. The woodworking edge plane of claim 1, further comprising:

a blade channel operative to house at least a portion of the blade and a wheel aperture operative to house the adjusting mechanism within the body of the woodworking edge plane.

4. The woodworking edge plane of claim 1, wherein the adjusting mechanism is an adjustment wheel.

5. The woodworking edge plane of claim 4, wherein the adjustment wheel is in threaded connection with the blade.

6. The woodworking edge plane of claim 1, wherein the first angled side and second angled side are at a 90 degree angle relative to one another.

7. The woodworking edge plane of claim 1, further comprising:

at least one blade window adapted to provide a path for material removed from the corner of the work piece.

8. The woodworking edge plane of claim 1, wherein the blade extends at least partially laterally below a top of the first angled side and the second angled side.

9. The woodworking edge plane of claim 1 wherein the cutting edge of the blade is rounded and is operable to shape the corner of the work piece into a rounded corner.

10. A method of shaping a corner of a board comprising:

placing an edge plane tool on a first side and a second side of a corner of a board to be shaped;

adjusting a blade having a first end, a second end, and a central portion with a projected portion having a first width and a recessed portion having a second width between the first end and the second end, so that a cutting edge on the first end of the blade is in contact with the corner of the board to be shaped with an adjustment mechanism;

passing the edge plane tool over the corner of the board to be shaped to cut the corner with the cutting edge of the blade; and removing material from the corner to create a shaped corner having one of a rounded and an angled corner surface.

11. The method of claim 10, further comprising:

adjusting the adjustment mechanism;

moving the cutting edge of the blade closer to the shaped corner;

passing the tool over the shaped corner;

contacting the blade with the shaped corner; and removing additional material from the edge to create a deeper shaped corner.

12. The method of claim 10, wherein placing the edge plane tool further comprises:

orienting the tool on the first side and second side of the corner to be shaped wherein the first side and second side are at right angles to one another.

13. The method of claim 10 further comprising:

removing the material through at least one blade window.

14. A woodworking edge plane comprising:

a blade having a first end, a second end, and a central portion between the first end and the second end, wherein the central portion further includes a projected portion having a first width and a recessed portion having a second width;

a cutting edge on the first end of the blade operable to engage and shape a corner of a work piece;

an adjusting mechanism in operative connection with the blade for adjusting the height of the blade relative to the corner of the work piece;

a first angled side; and a second angled side; wherein the first angled side and second angled sides are operative to contact at least two sides of the work piece.

15. The woodworking edge plane of claim 14, wherein the first width is greater than the second width.

16. The woodworking edge plane of claim 14, wherein the projected portion prevents the blade from overextending.

17. The woodworking edge plane of claim 15, wherein the cutting edge has a third width.

18. The woodworking edge plane of claim 16, wherein the third width is greater than that of a width of a blade channel defined in the body of the woodworking edge plane to prevent the cutting edge of the blade from retracting within the body of the edge plane.

* * * * *